US006245199B1

(12) United States Patent
Lee

(10) Patent No.: US 6,245,199 B1
(45) Date of Patent: Jun. 12, 2001

(54) AUTOMATIC PULP-FORMING MOLD-RELEASING MACHINE

(76) Inventor: Vincent Lee, 7F NO. 109, SEC. 6, Min-Chyuan East RD., Ney-HwuArea, Taipei city (TW)

( * ) Notice: Subject to any disclaimer, the term of this patent is extended or adjusted under 35 U.S.C. 154(b) by 0 days.

(21) Appl. No.: 09/401,269

(22) Filed: Sep. 23, 1999

(51) Int. Cl.[7] ..... D21J 3/00; D21J 7/00

(52) U.S. Cl. ..... 162/385; 162/382; 162/387; 162/391; 425/85

(58) Field of Search ..... 162/218–228, 162/230, 382–395, 411; 249/113, 141; 264/86, 87; 425/85

(56) References Cited

U.S. PATENT DOCUMENTS

| | | | | |
|---|---|---|---|---|
| 2,234,979 | * | 3/1941 | Randall et al. | 162/377 |
| 2,494,743 | * | 1/1950 | Chaplin | 162/224 |
| 5,971,169 | * | 10/1999 | Bodary et al. | 162/218 |
| 6,048,440 | * | 4/2000 | Baker | 162/388 |

* cited by examiner

*Primary Examiner*—Stanley S. Silverman
*Assistant Examiner*—Eric Hug
(74) *Attorney, Agent, or Firm*—Bacon & Thomas, PLLC

(57) ABSTRACT

A automatic pulp-forming mold-releasing machine comprising a lower mold disposed inside of a frame body, capable of reciprocatingly turning upside down and having protruding forming parts at top and bottom sides thereof which include air vents on the surface thereof capable of drawing and blowing air, and two synchronically reciprocatingly laterally shifting slide holders disposed at the top of the frame body and having upper mold lifting devices to drive the upper molds to move upwards and downwards, and air-drawing and air-blowing vent provided inside of the upper molds, and a liftable pulp container disposed under the lower mold of the frame body, characterized in that the pulp is absorbed to the forming parts at the bottom side of the lower mold; thereafter, it turns upside down to the top side, after dehydrated by the down-pressing of the upper mold, the formed pulp is absorbed upwards and lifted to be separate from the mold while the upper mold is laterally slid by the slide holder in position so that the mold-releasing formed pulp falls on the transport belt in order to achieve a rapid, effective and automatic pulp-forming mold-releasing effect.

5 Claims, 13 Drawing Sheets

A-A VIEW

AUTOMATIC PULP-FORMING MOLD-RELEASING MACHINE

BACKGROUND OF THE INVENTION

1. Field of the Invention

The present invention relates to an automatic pulp-forming mold-releasing machine, and more particularly, to a machine having a double-sided turnable lower mold to press and to release mold in coordination with two upper molds while the formed pulp is placed on the pre-arranged transport belt in order to reach the goal of rapid and automatic production.

2. Description of the Prior Art

As shown in FIG. 1, the conventional pulp-forming mold-releasing machine is provided with a pulp container 51 fixed in the frame body 5 and containing pulp raw material. An vertically liftable upper mold 52 driven by an upper mold driving device 521 is disposed over the pulp container 51 and includes a plurality of protruding forming parts 522 at the bottom side thereof having a plurality of air vents on the surface thereof through which the suction or the pushing force is created when the air flows in and flows out. A laterally movable table 531 is disposed between the pulp container 51 and the upper mold 52 and includes a plurality of mold seats 53 at one side thereof which are moved with the mold seats 53 to the descending route of the upper mold 52. The upper mold 52 contains a vertically liftable die casting 54 driven by a die casting driving device 541 and disposed at one side thereof. The die casting 54 includes air-passing vents on the surface thereof.

The whole operation is performed as follows: The upper mold 52 is driven by the upper mold driving device 521 to descend into the pulp container 51 while a vacuum suction is created in the air vents on the surface of the forming parts 522 to absorb pulp of certain amount. Thereafter, the upper mold driving device 521 drives the upper mold 52 to ascend while the movable table 531 is laterally so shifted that the mold seat 53 is located under the upper mold 52, and the air vents on the surface of the forming parts begins to blow air so that the slightly formed pulp on the surface thereof falls into the mold seat 53, and then the movable table returns to the original position so that the mold seat 53 is shifted under the die casting 54. Driven by the die casting driving device 541, the die casting 54 descends to press on the mold seat 53 so that the pulp therein is dehydrated and formed. Thereafter, the air vents on the surface of the die casting 54 draw air so that the formed and dehydrated pulp is absorbed to rise with the die casting 54. At this time, the movable table 531 is laterally shifted to the lower side of the upper mold 52 again (the upper mold 52 absorbs pulp of certain amount by means of the forming parts 522 again) in order for the mold seat 53 to receive the pulp supplied by the upper mold 52. Meanwhile, the air vents on the surface begin to blow air so that the formed and dehydrated pulp falls on another side of the movable table 531 and is transported with the return of the movable table 531 to the next working procedure (e.g. wind drying etc.) for further processing.

Though the above-mentioned construction can reach the basic automatic processing, the whole operation procedure is too complex. Additionally, each processing step will take certain time to create a best production effect. Accordingly, the production efficiency is too low to meet the economic requirement and the whole production procedure is seriously influenced.

SUMMARY OF THE INVENTION

It is a main object of the present invention to provide an automatic pulp-forming mold-releasing machine comprising a lower mold disposed inside of a frame body, capable of reciprocatingly turning upside down and having protruding forming parts at top and bottom sides thereof which include air vents on the surface thereof capable of drawing and blowing air, and two synchronically reciprocatingly laterally shifting slide holders disposed at the top of the frame body and having lifting devices to drive the upper molds to move upwards and downwards, and air-drawing and air-blowing vents provided inside of the upper molds, and a liftable pulp container disposed under the lower mold of the frame body, characterized in that the pulp is absorbed to the forming parts at the bottom side of the lower mold; thereafter, it turns upside down to the top side, after dehydrated by the down-pressing of the upper mold, the formed pulp is absorbed upwards and lifted to be separate from the mold while the upper mold is laterally slid by the slide holder in position so that the mold-releasing formed pump falls on the transport belt in order to achieve a rapid, effective and automatic pulp-forming mold-releasing effect.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
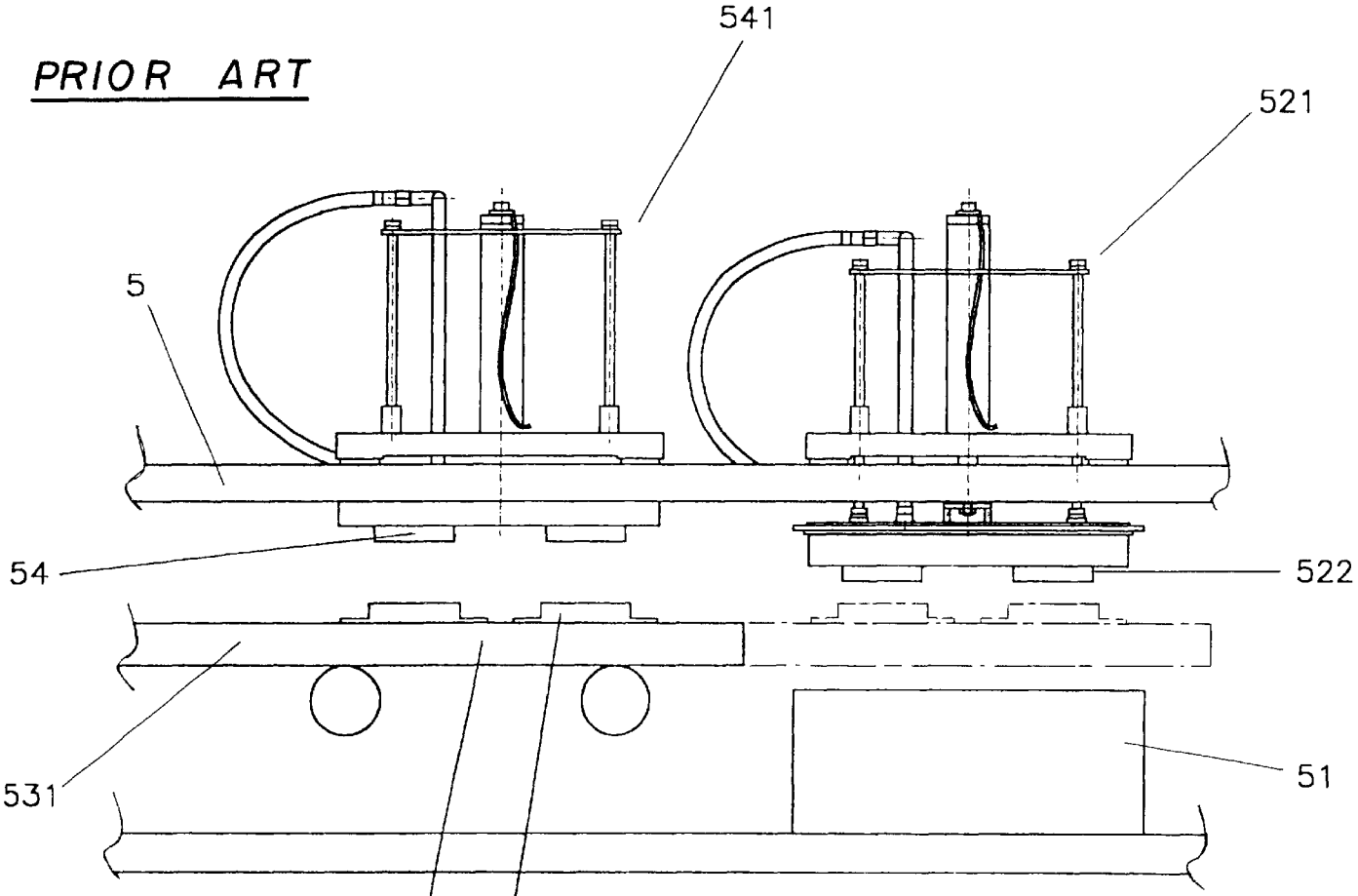
FIG. 1 is a schematic drawing of a conventional pulp-forming mold-releasing machine.

As shown in FIG. 1, the configuration and disadvantages of the conventional pulp-forming mold-releasing machine have been described above and will not repeat hereafter.

Figure 2:
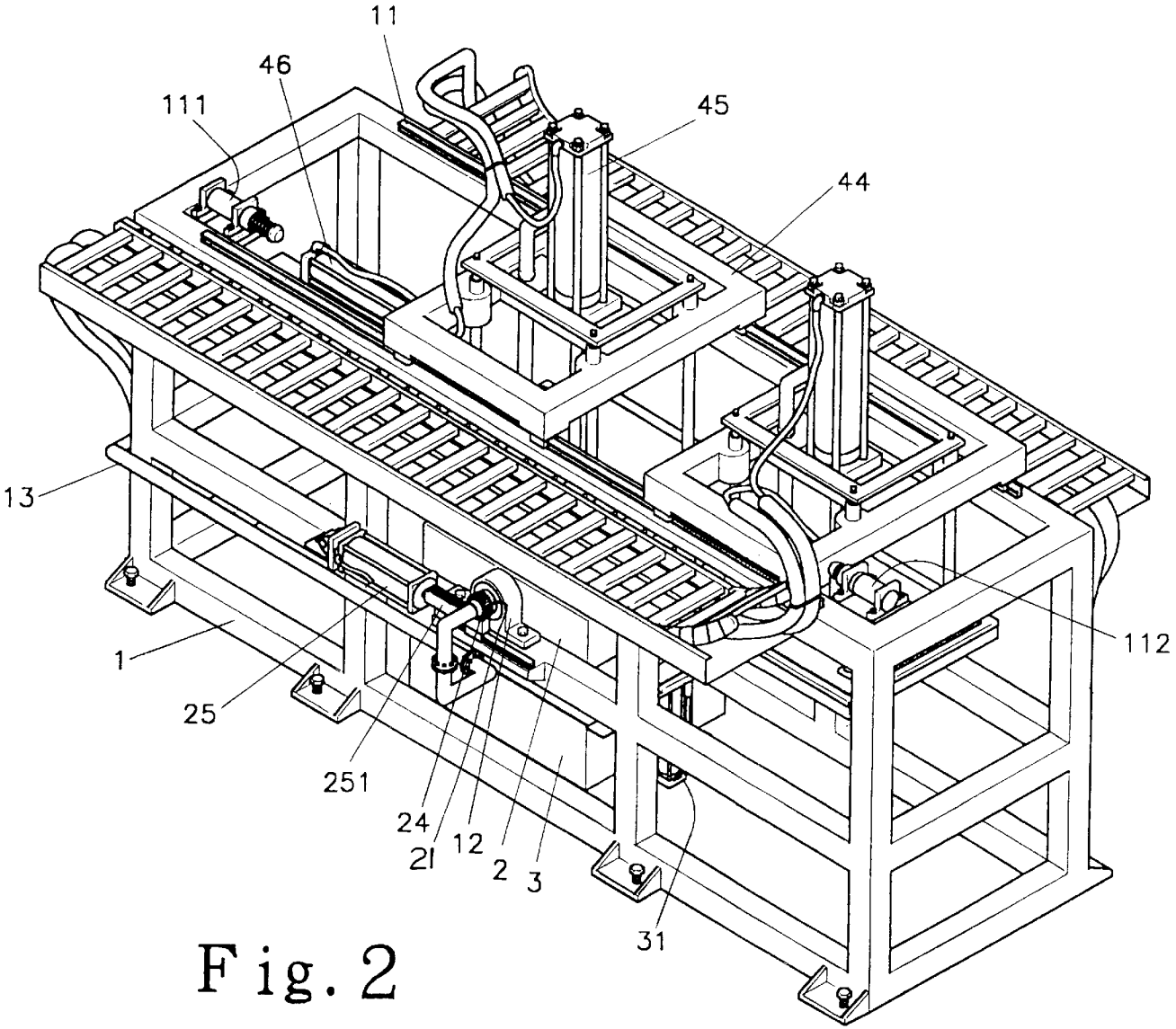
FIG. 2 is a perspective assembly of the present invention.
Figure 3:
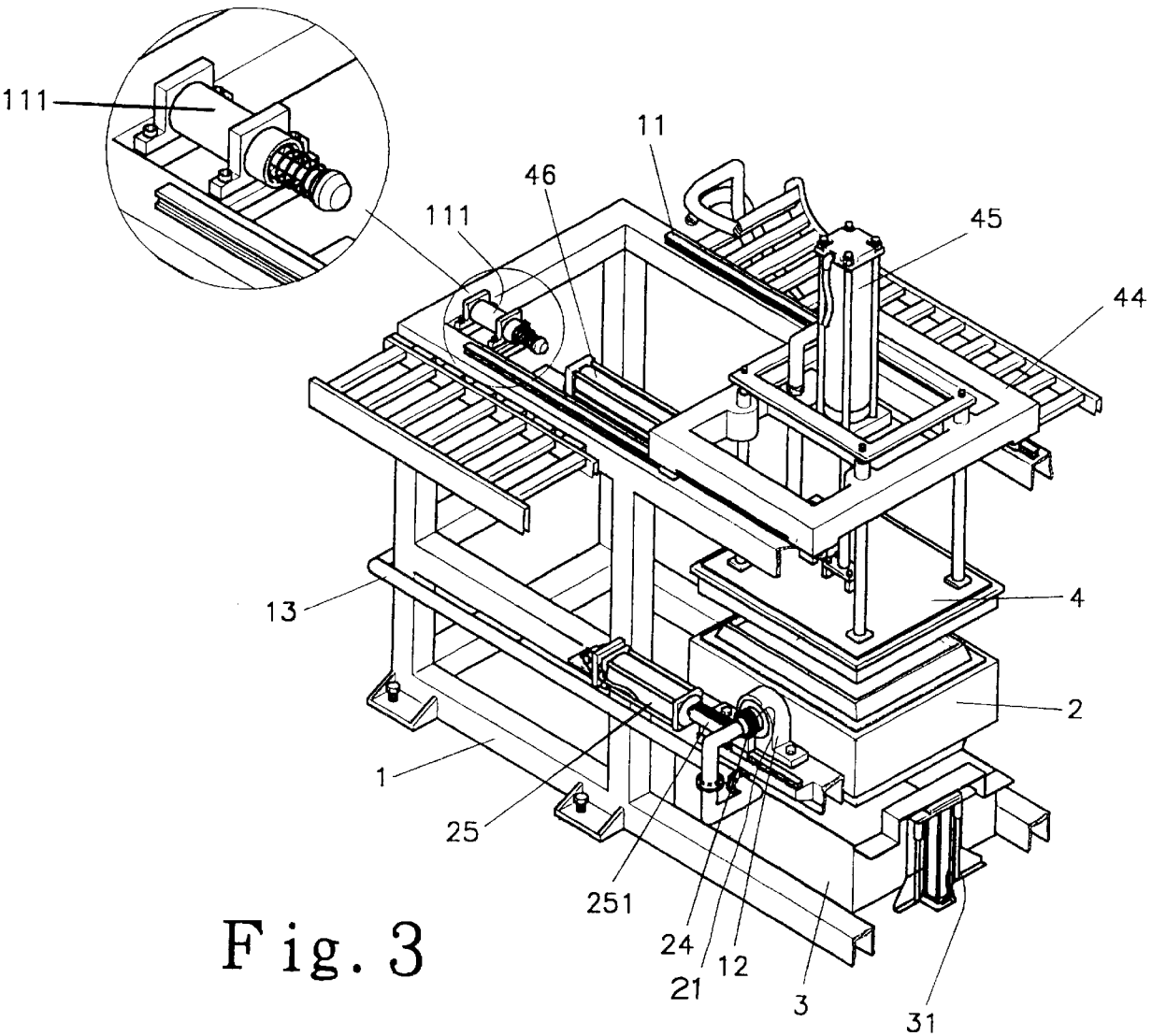
FIG. 3 is a perspective assembly view of the partial structure of the present invention.

FIG. 2 and FIG. 3 show perspective assembly views of the present invention. As shown in FIG. 3, the present invention includes a frame body 1, a lower mold 2, a pulp container 3 and an upper mold 4. The top sides of the frame body 1 are respectively provided with two parallel extending guide rails 11 having trigger switches 111, 112 at the ends thereof. The two side of the central part of the frame body 1 contains two bearing blocks 12 corresponding to the guide rails 11 while a vent pipe 13 is disposed in the middle of the bearing block 12 in order to connect to the external part. The lower mold 2 is mounted inside of the frame body 1 and has a shaft 21 respectively outwards laterally disposed at two sides of the center thereof and two shafts 21 penetrate through respective bearings pre-arranged in the bearing blocks 12 and are connected to the vent pipes 13 so that the lower mold 2 can be rotated on the shafts 21. The end of the shaft 21 includes a gear 24 while a rotation driving device 25 is provided at the side of the bearing block 12 to drive a gear chain 251 to engage with the gear 24. The pulp container 3 is provided under the lower mold 2 and the two sides thereof are upwards and downwards movable by means of at least two lifting devices 31 for the pulp container 3. A plurality of the upper molds 4 are disposed over the top of the lower mold 2 and each upper mold 4 is located on the slide holder 44 by means of the lifting device 45 for the upper mold. The slide holder 44 is placed on the two guide rails 11 and movable on the guide rails 11 by means of a lateral shifting device 46 for the upper mold. Moreover, the upper mold 4 is reciprocatingly upwards and downwards movable by means of a lifting device 45 for the upper mold.

Figure 4:
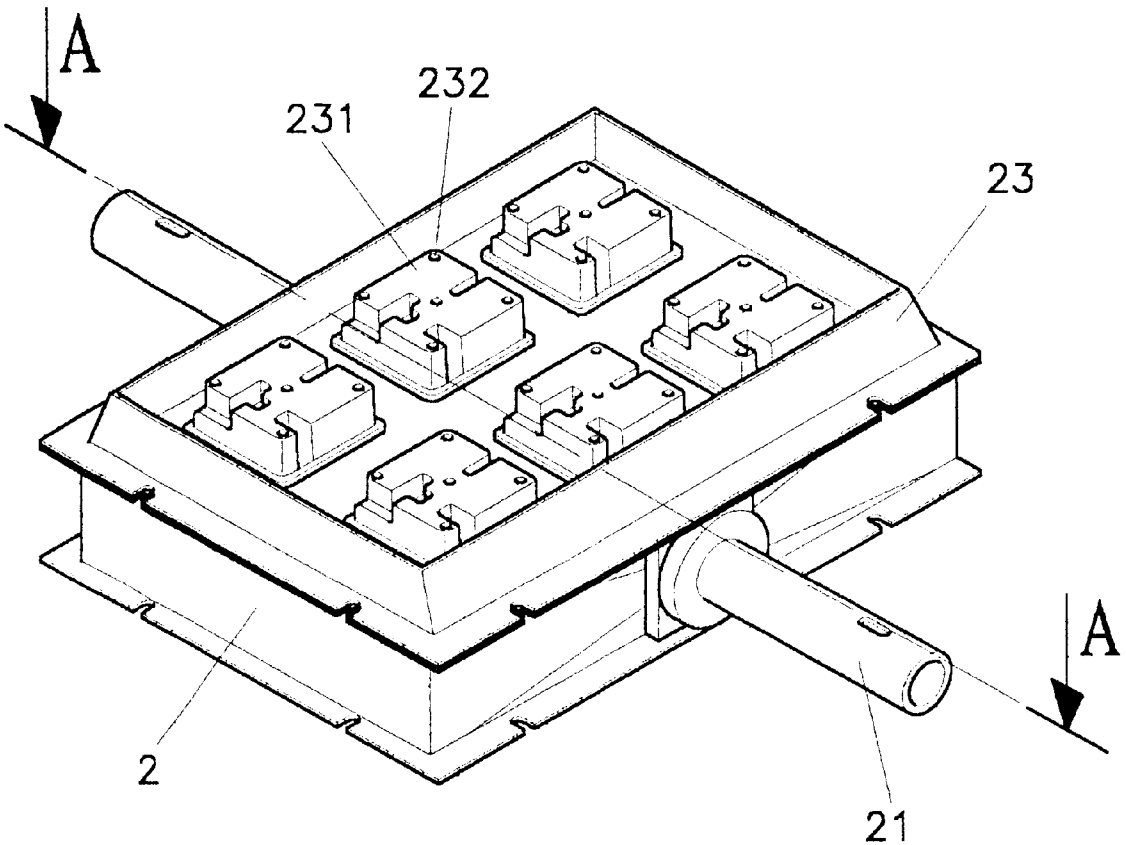
FIG. 4 is a perspective view of a lower mold of the present invention.
Figure 4A:
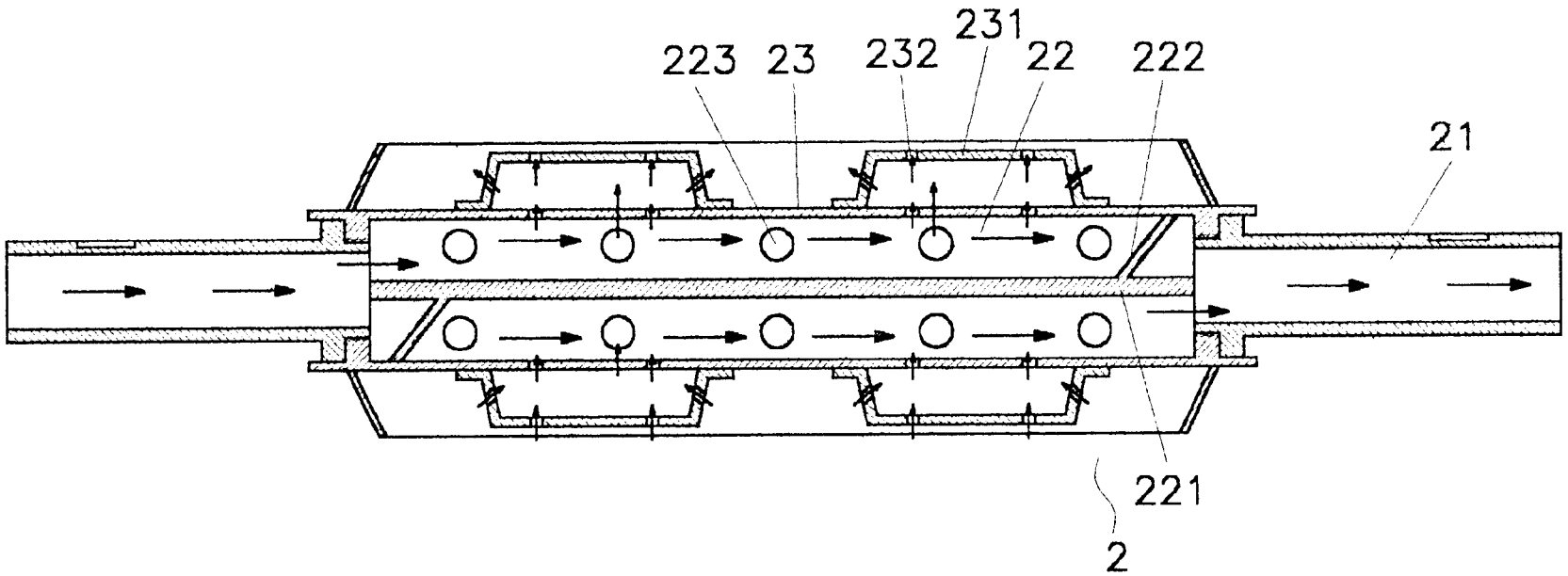
FIG. 4A is a sectional view of the lower mold of the present invention taken along the line A—A of FIG. 4.
Figure 4B:
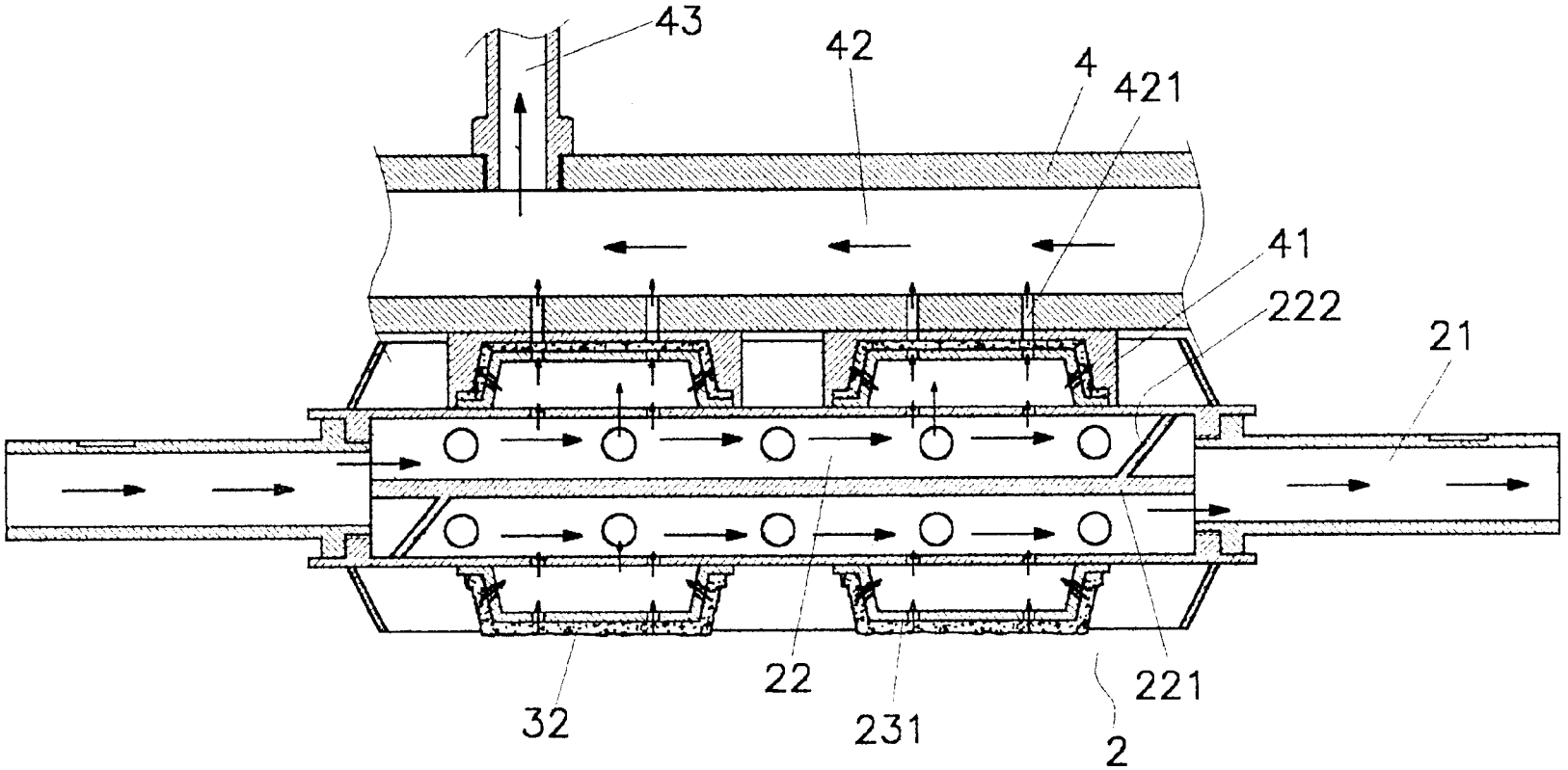
FIG. 4B is a sectional assembly view of the upper and lower mold of the present invention.
Figure 5:
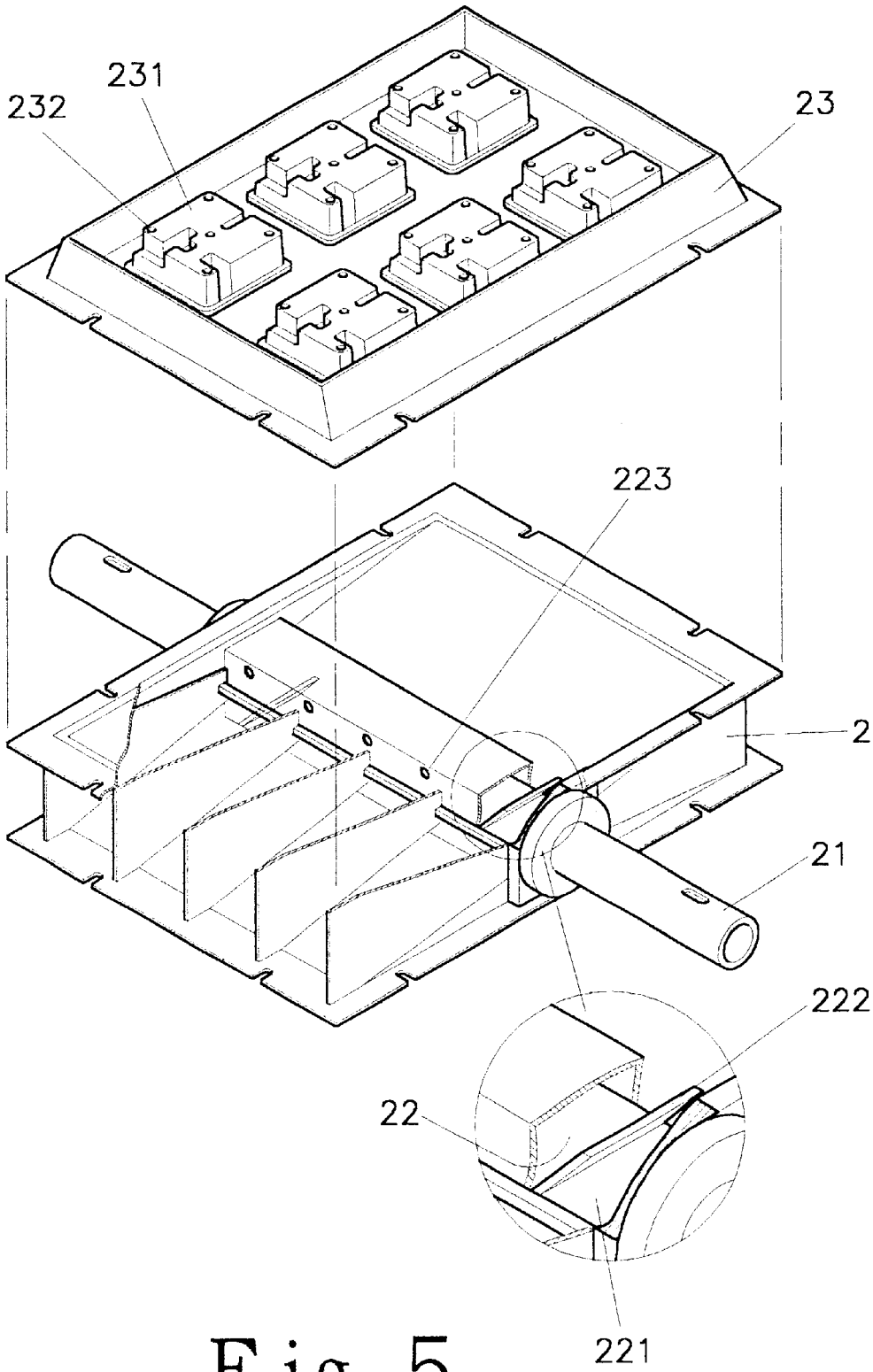
FIG. 5 is an exploded view of the lower mold of the present invention.

FIG. 4 shows a perspective view of a lower mold of the present invention. Referring also to FIGS. 4A, 4B and 5, the middle section of the lower mold 2 is laterally provided with a ventilation airway 22 which is outwards extended from two ends thereof by means of the shaft 21. The center of the ventilation airway 22 includes a partition 221 by which the ventilation airway 22 is divided into an upper and a lower airway. The two ends of the upper and lower airways are slantwise blocked by bracing plates 222 respectively so that the upper and lower airways are respectively connected to the shaft 21 at two sides. A plurality of air vents 223 is provided to be connected to the inside of the lower mold 2. The top and bottom of the lower mold 2 can be covered with a cover 23 respectively on which a plurality of forming parts 231 are protrudingly provided each of which includes a plurality of air vents 232 to connect to the external elements.

Figure 6:
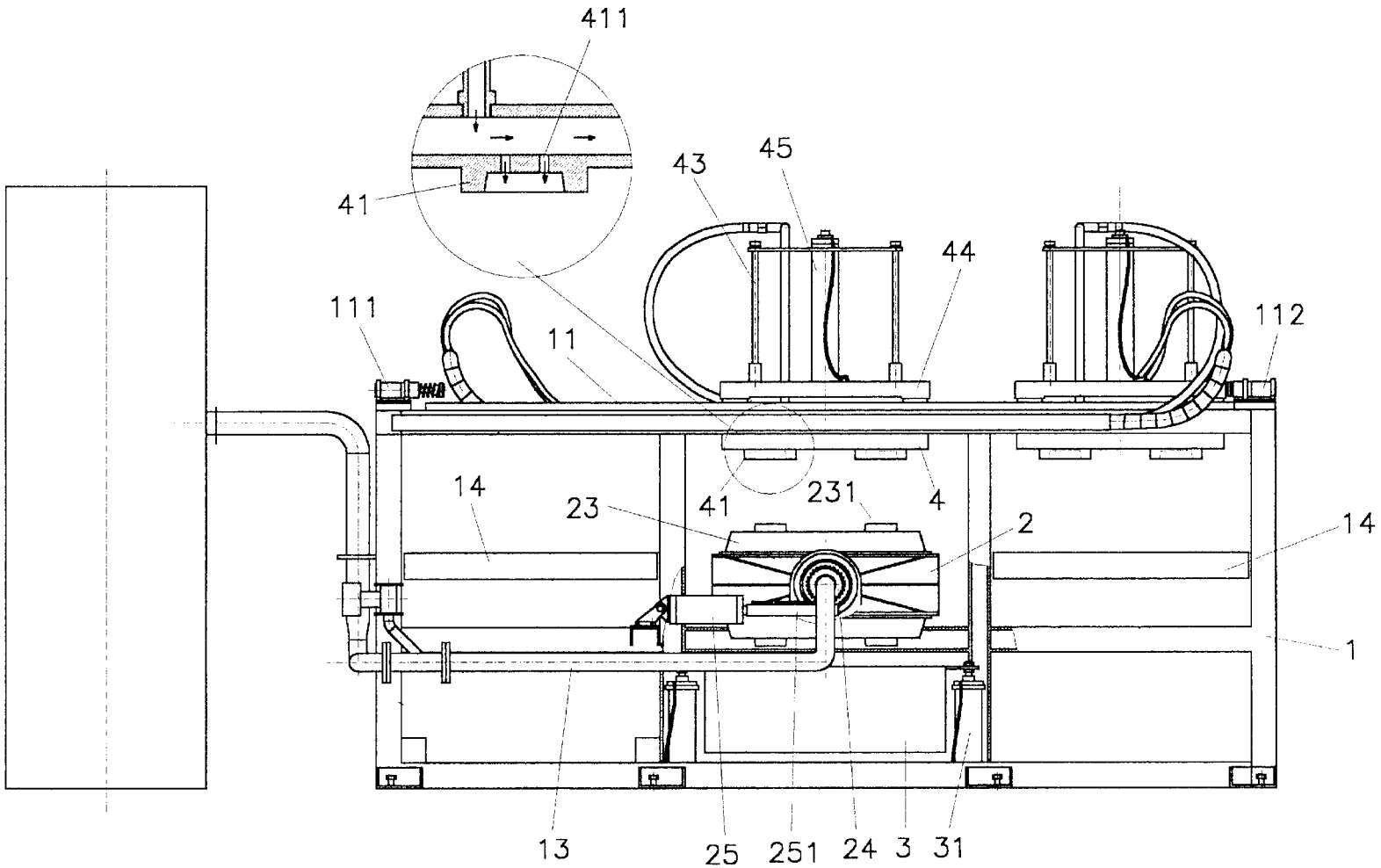
FIG. 6 is a side view of the present invention.

FIG. 6 shows a side view of the present invention. Referring also to FIGS. 2 and 4B, the shaft 21 of the lower mold 2 is placed on the bearing blocks 12 by means of the bearing to be connected to the vent pipe 13. The gear 24 at the end of the shaft 21 is engaged with the gear chain 251 driving the rotation driving device 25. The lower mold 2 includes a parallel extending transport belt 14 respectively at two sides thereof which is situated on the movement route. The bottom side of the upper mold 4 is concavely provide with forming parts 41 corresponding to the forming parts 231 while a plurality of air vents 421 are disposed in the forming parts 41 connected to the ventilation airway 42 in the upper mold 4. The ventilation airway 42 is connected to the external by means of another ventilation pipe 43.

Figure 7:
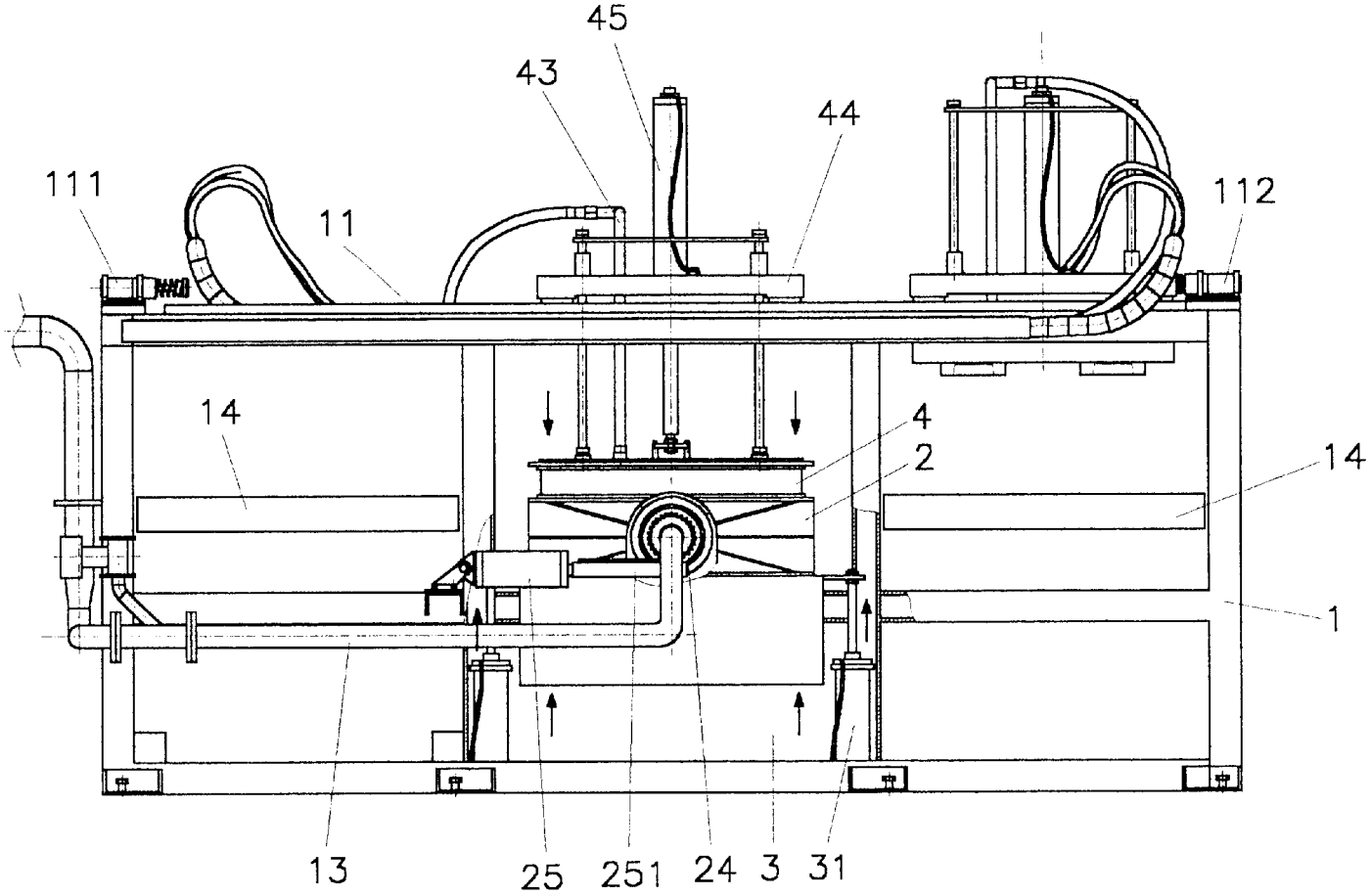
FIG. 7 is a first schematic drawing of the present invention illustrating the working operation thereof.
Figure 8:
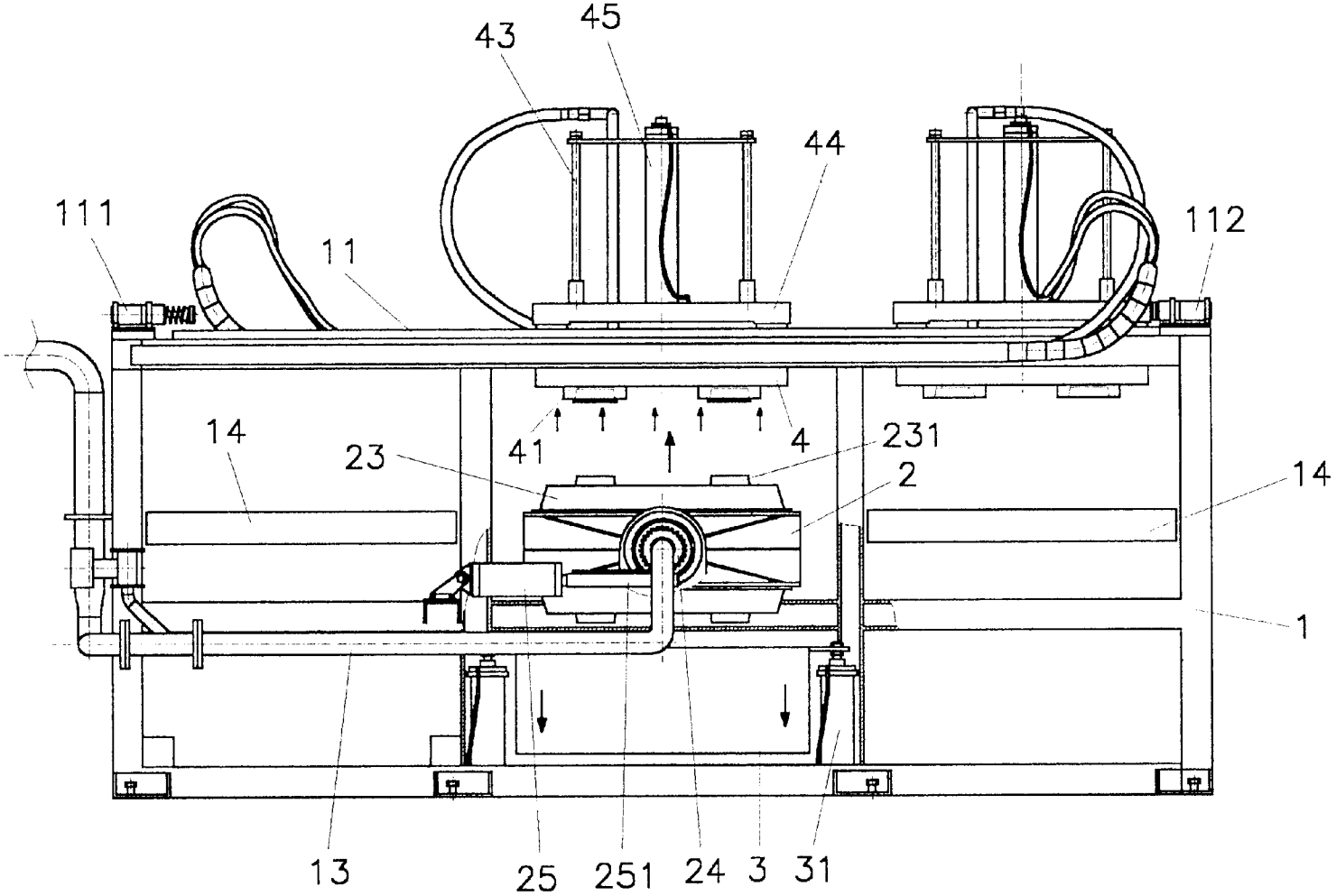
FIG. 8 is a second schematic drawing of the present invention illustrating the working operation thereof.
Figure 9:
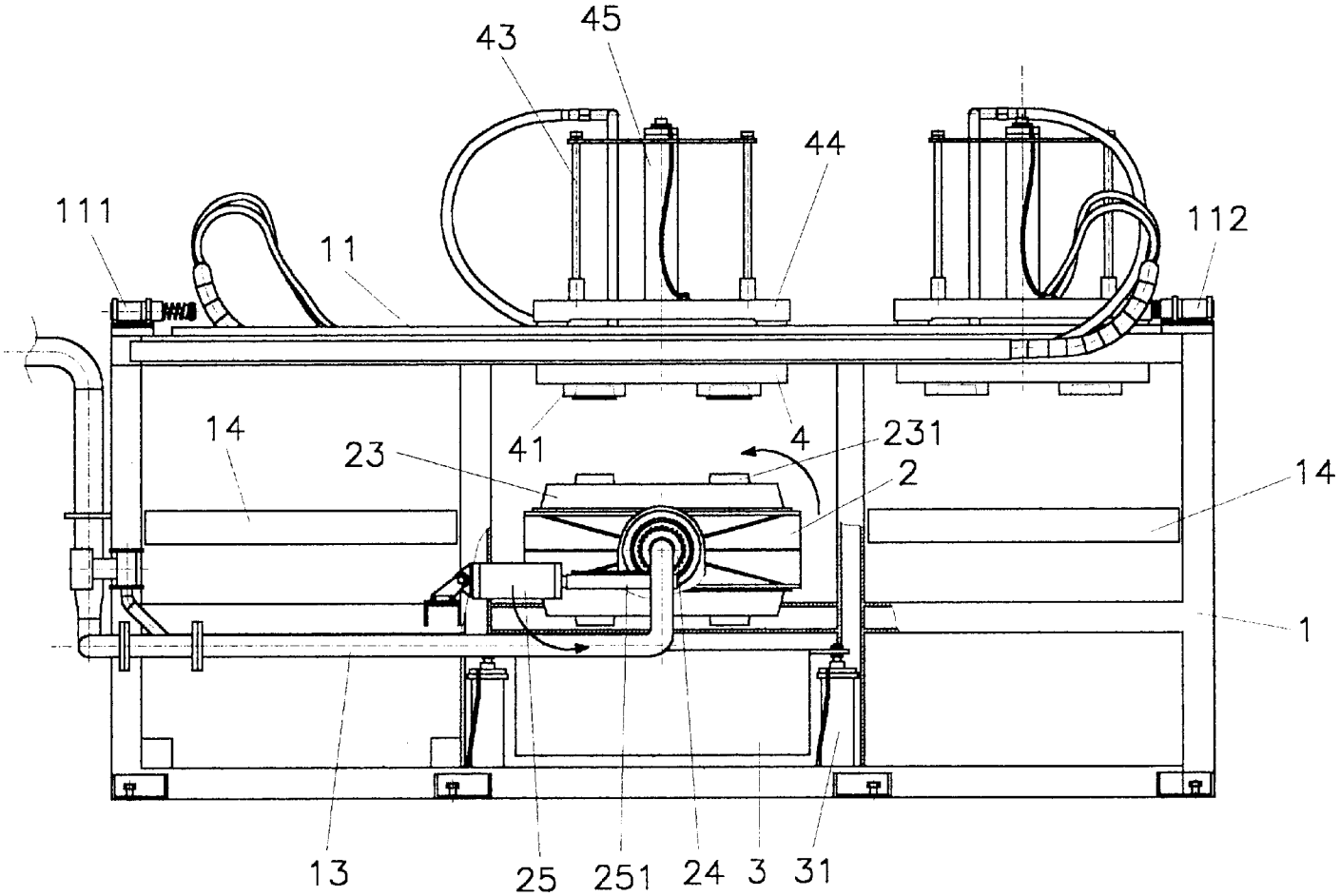
FIG. 9 is a third schematic drawing of the present invention illustrating the working operation thereof.
Figure 10:
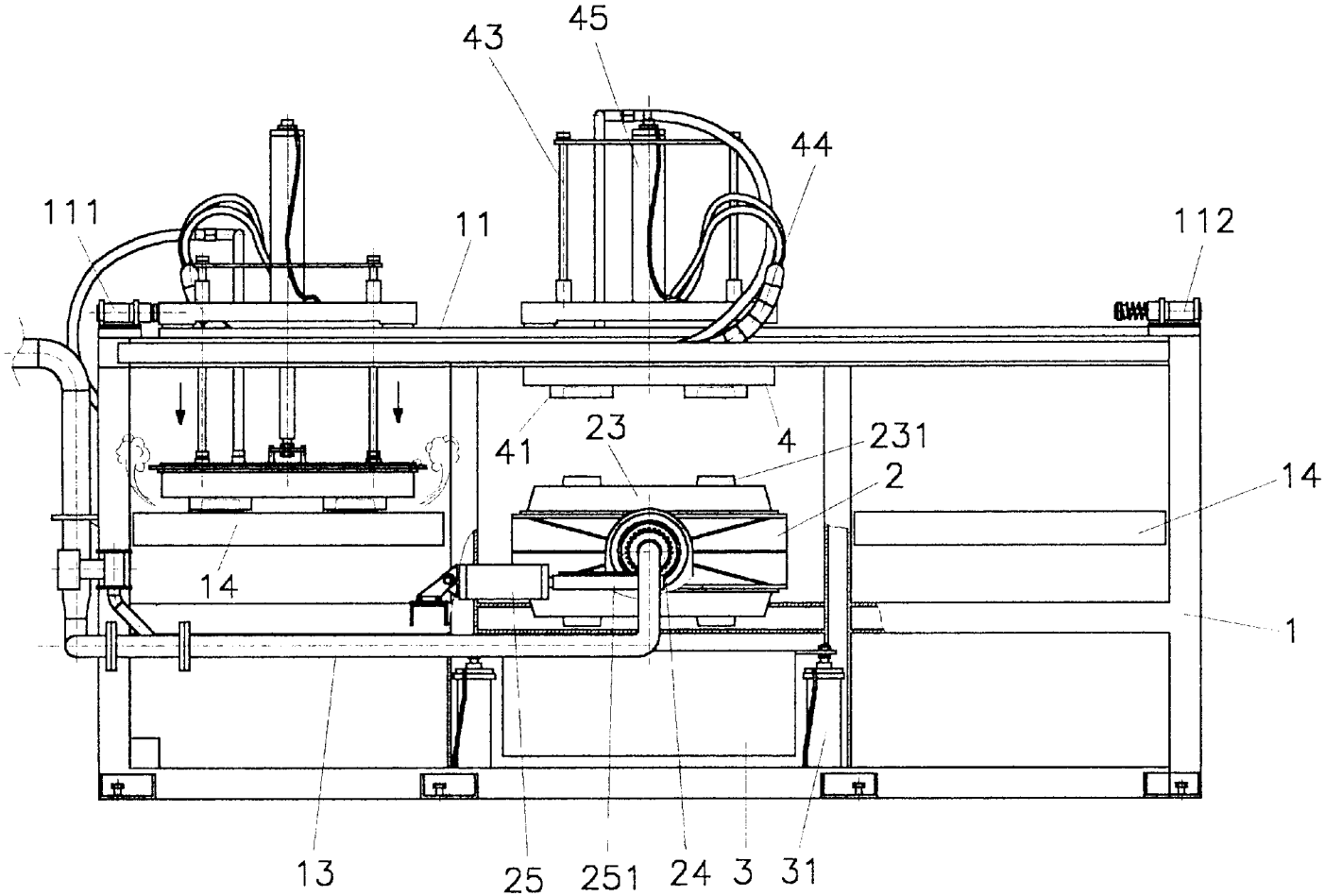
FIG. 10 is a fourth schematic drawing of the present invention illustrating the working operation thereof.
Figure 11:
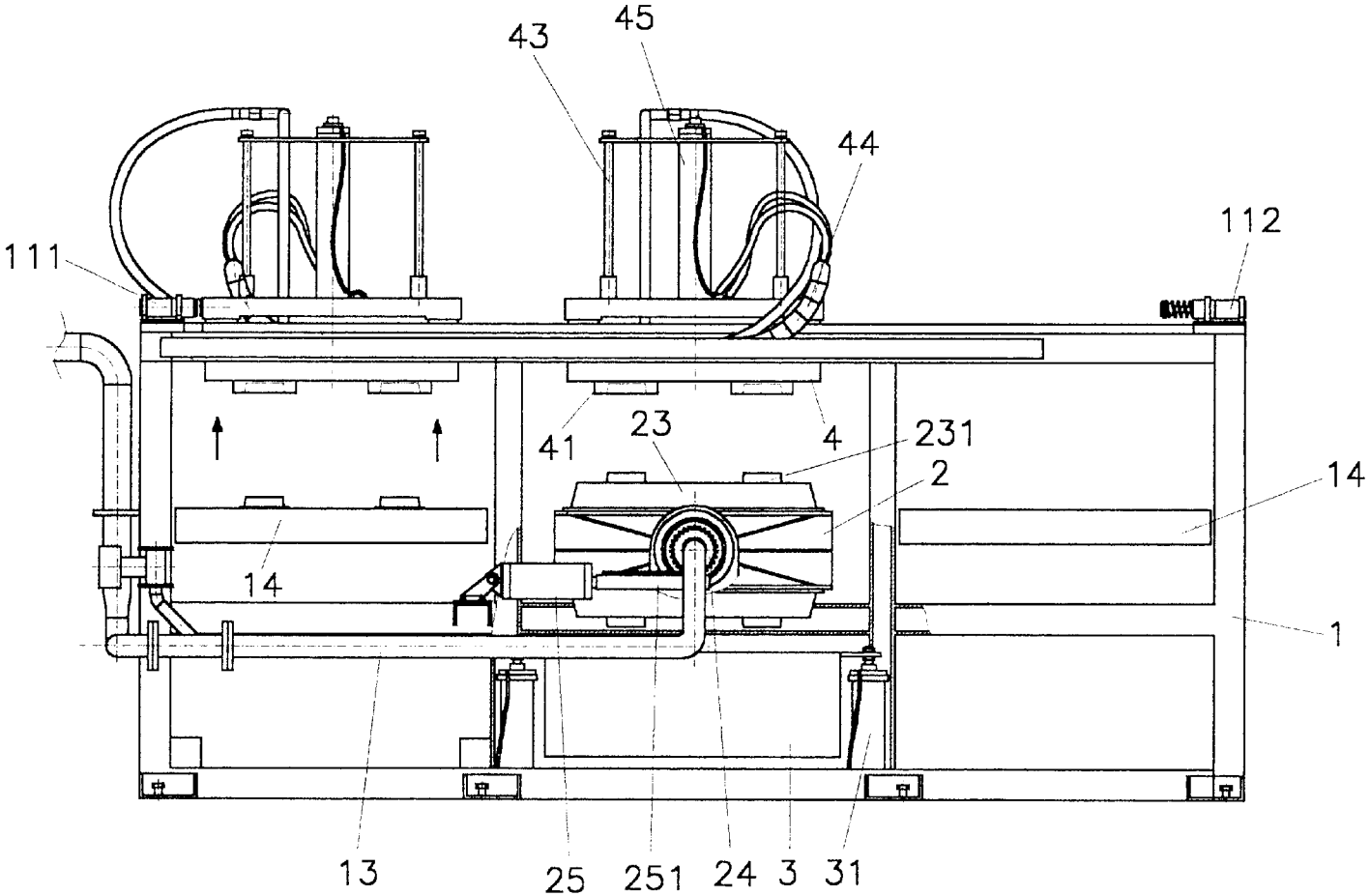
FIG. 11 is a fifth schematic drawing of the present invention illustrating the working operation thereof.

FIGS. 7 through 11 show schematic drawings of the present invention illustrating the working operation thereof. In FIG. 7 is shown that the pulp container 3 is driven by the lifting device 31 and lifted to the bottom of the lower mold 2 so that one side of the shaft 21 connected to the ventilation airway 22 of the bottom side begins to draw air while the pulp 32 in the pulp container 3 is drawn to the external surface of the forming parts 231 (as shown in FIG. 4B) by means of the vacuum suction of the air vents 223, 232. The suction will be diminished when the pulp 32 becomes thicker and thicker. The slide holder 44 is exactly located over the lower mold 2. And the upper mold 4 is lowered by the lifting device 45 so that the forming parts 41 thereof are pressed on the forming parts 231 of the lower mold 2. The moisture in the pulp 32 on the surface of the forming parts 231 is squeezed out and the pulp 32 is fixed and formed. At this time, the ventilation pipe 43 begins to draw air while the shaft 21 connected to the ventilation airway 22 at the top side is gradually charged with air (see FIG. 4B). After the pulp 32 is dried and formed, the pulp container 3 is lowered (the pulp 32 with appropriate thickness has been absorbed and attached on the surface of the forming parts 231). At the same time, the upper mold 4 is lifted by the upper mold lifting device 45. The ventilation pipe 43 keeps evacuating so that the ventilation airways 42 are almost in a vacuum state. The suction is produced by means of the air vents 421 so that the formed pulp 32 will be attracted by the forming parts 41 to be separate from the forming parts 231 (as shown in FIG. 8). Then, the lateral shifting device 46 for the upper mold is activated to move the two slide holders 44 with a synchronic sliding (the slide holder 44 at the center slides to the side while another slide holder 44 at the side is moved to the center). In addition, the rotation driving device 25 drives the gear chain 251 to move the gear 24 so that the lower mold 2 is turned on the shaft 21 at 180° (as shown in FIG. 9). The slide holder 44 will stop in touching either of the trigger switches 111, 112. The upper mold 4 originally at the side is moved to the top of the lower mold 2 at the center for locating in place. Thereafter, the lifting device 45 is activated to place the upper mold 4 at the top of the transport belt 14, and the ventilation pipe 43 is charged with air while the air is driven outwards through the air vents 421 so that the formed pulp 32 in the forming parts 41 is blown off at the top of the transport belt 14 (shown in FIG. 10) for transporting to the next working procedure (e.g. air blowing, wind drying etc.). Thereafter, the lifting device 45 for the upper mold is returned in a collection state in order that the upper mold 4 is lifted in place (as shown in FIG. 11). All steps of FIGS. 7 through 11 are repeated to perform the next cycle.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An automatic pulp-forming mold-releasing machine at least comprising:

a frame body having two parallel extending guide rails at top sides thereof, having two transport belt laterally and parallel extending along said guide rails at two sides of the central part thereof, two bearing blocks corresponding to said guide rails while a vent pipe is disposed in the middle of said bearing block in order to connect to the external;

a lower mold disposed inside of said frame body, having protruding forming parts at upper and lower sides which include air vents on the surface thereof for drawing and supplying air, and the middle section thereof is laterally provided with a ventilation airway, the center of which includes a partition by which said ventilation airway is divided into an upper and a lower airways respectively connected to forming parts of the top and bottom sides, and said lower mold having a shaft respectively outwards laterally disposed at two sides of the center thereof while said two shafts are connected to said upper and lower ventilation airways, penetrate through respective bearings pre-arranged in bearing blocks, are connected to vent pipes, and are respectively connected to a rotation driving device so that said lower mold can be rotated on said shafts;

a pulp container disposed under said lower mold and upwards and downwards liftable by means of a plurality of lifting devices at two sides thereof;

two upper molds respectively located by two lifting devices on two slide holders which are placed slideable on said two guide rails, and said upper molds having concave forming parts at the bottom side, including air vents on the surface thereof for drawing and supplying air, and said upper molds driven by a lateral shifting device so that two slide holders can be slid on said guide rails while said upper molds is driven by a lifting device to bring said upper molds in a reciprocating lifting movement;

characterized in that said pulp container is lifted to be adjacent to the bottom side of said lower mold while said shafts connected to said forming parts at bottom side begin to draw air so that the pulp can be absorbed and attached on the surface of said forming parts; thereafter, said upper mold is turned over at 180° to let the face of said absorbed and attached pulp upwards while said forming parts of said upper mold are driven by said shifting device to press on said pulp; thereafter, when said pulp is dehydrated by pressing and formed, said upper mold begins to draw air to absorb said formed pulp which is carried by lateral shifting device to the upper side of said transport belt while said upper mold blows said formed pulp to fall on said transport belt so that the rapid and effective pulp-forming and mold-releasing action can be achieved by the reciprocating turning upside down of said lower mold in coordination with the reciprocating lateral shift of said upper mold.

2. The automatic pulp-forming mold-releasing machine as claimed in claim 1, wherein the end of said shaft includes a gear while a rotation driving device is provided at the side of said bearing block to drive a gear chain to engage with said gear so that said lower mold is rotateable after the activation of said rotation driving device.

3. The automatic pulp-forming mold-releasing machine as claimed in claim 2, wherein said rotation driving device is a pneumatic cylinder.

4. The automatic pulp-forming mold-releasing machine as claimed in claim 1, wherein two trigger switches are respectively disposed at the external end of said two guide rails at the top of said frame body and can be used to locate said lower mold exactly over said lower mold after being touched by said slide holders.

5. The automatic pulp-forming mold-releasing machine as claimed in claim 1, wherein said upper molds are provided inside with ventilation airways connected to said air vents of said forming parts while a vacuum and blowing effect is created by said air vents of said forming parts when said ventilation airways draw and supply air.

* * * * *